US009869446B2

(12) United States Patent
Kim et al.

(10) Patent No.: US 9,869,446 B2
(45) Date of Patent: Jan. 16, 2018

(54) RADIATING DEVICE FOR A LIGHTING DEVICE HAVING FIRST AND SECOND RADIATING MODULES

(71) Applicant: LG INNOTEK CO., LTD., Seoul (KR)

(72) Inventors: Ji Hoon Kim, Seoul (KR); Sung Min Kim, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 148 days.

(21) Appl. No.: 14/172,498

(22) Filed: Feb. 4, 2014

(65) Prior Publication Data

US 2014/0218950 A1 Aug. 7, 2014

(30) Foreign Application Priority Data

Feb. 4, 2013 (KR) ..... 10-2013-0012308

(51) Int. Cl.
*F21S 8/10* (2006.01)
*F28F 3/00* (2006.01)

(52) U.S. Cl.
CPC ..... *F21S 48/321* (2013.01); *F21S 48/328* (2013.01); *F21S 48/34* (2013.01); *F28F 3/00* (2013.01)

(58) Field of Classification Search
CPC ..... F21S 48/328; F21S 48/32; F21S 48/321; F21S 48/34; F28F 3/00
See application file for complete search history.

(56) References Cited

U.S. PATENT DOCUMENTS

| | | | | |
|---|---|---|---|---|
| 4,555,748 | A | 11/1985 | Bradley | |
| 7,926,979 | B2 * | 4/2011 | Lai | F21V 29/004 362/253 |
| 8,419,250 | B2 * | 4/2013 | Ohsawa | 362/547 |
| 2004/0252502 | A1 | 12/2004 | McCullough et al. | |
| 2007/0121336 | A1 | 5/2007 | Chinniah et al. | |
| 2007/0153548 | A1 * | 7/2007 | Hamada et al. | 362/615 |

(Continued)

FOREIGN PATENT DOCUMENTS

| | | | |
|---|---|---|---|
| DE | 102007050924 | A1 | 5/2009 |
| EP | 2535642 | A2 | 12/2012 |

(Continued)

OTHER PUBLICATIONS

Office Action dated Nov. 26, 2015 in Chinese Application No. 201410043761.5.

(Continued)

*Primary Examiner* — Robert May
(74) *Attorney, Agent, or Firm* — Saliwanchik, Lloyd & Eisenschenk

(57) ABSTRACT

Provided are a radiating device and a lighting device, including a first radiating module configured to receive heat generated from a light source module; and a second radiating module that comprises a first member extending to the first radiating module and transmitting the received heat, and a second member configured to emit the heat transmitted from the first member to a light emitting space, and thus a production cost and a weight can be reduced, space utilization can be improved, and snow melting of an optical member can be realized.

11 Claims, 7 Drawing Sheets
(3 of 7 Drawing Sheet(s) Filed in Color)

(56) References Cited

U.S. PATENT DOCUMENTS

| | | | | |
|---|---|---|---|---|
| 2008/0019134 | A1* | 1/2008 | Mukai | F21K 9/00 362/294 |
| 2013/0057153 | A1* | 3/2013 | Kim et al. | 315/113 |

FOREIGN PATENT DOCUMENTS

| | | | | |
|---|---|---|---|---|
| GB | 2430071 | A | | 3/2007 |
| JP | 2006294263 | A | | 10/2006 |
| JP | 2007234449 | A | | 9/2007 |
| JP | 2007242291 | A | | 9/2007 |
| JP | 2007273369 | A | | 10/2007 |
| JP | 2010102997 | A | | 5/2010 |
| JP | 2011028906 | A | * | 2/2011 |
| WO | WO-2004055433 | A1 | | 7/2004 |

OTHER PUBLICATIONS

European Search Report dated Jul. 19, 2016 in European Application No. EP14153233.

* cited by examiner (a)

(b)

RADIATING DEVICE FOR A LIGHTING DEVICE HAVING FIRST AND SECOND RADIATING MODULES

CROSS-REFERENCE TO RELATED APPLICATION

This application claims the benefit under 35 U.S.C. §119 of Korean Patent Application No. 10-2013-0012308, filed Feb. 4, 2013, which is hereby incorporated by reference in its entirety.

BACKGROUND OF THE INVENTION

Field of the Invention

Embodiments of the present invention relate to a radiating device, a lighting device including the same, and a lighting device for a vehicle.

Description of the Related Arts

A light emitting diode (LED) device is directed to converting an electrical signal to infrared rays or light using the properties of a compound semiconductor. Unlike a fluorescent lamp, the LED device does not use any harmful substances such as mercury, which results in less environment contamination, and has an advantage that its life span is longer as compared to a conventional light source. The LED device also consumes low electric power as compared to a conventional light source, and shows excellent visibility and low glariness thanks to a high color temperature. Thus, the LED device has been widely used as a light source of a head lamp for a vehicle.

However, a head lamp for a vehicle shows a basic environmental temperature of approximately about 80° C. due to the heat of an engine, and is vulnerable to the radiation of heat because it is sealed, so an increase in its internal temperature has an influence on the LED's life span. Accordingly, a radiating system with high performance capable of effectively emitting heat generated from the LED is needed, so a fan for emitting the heat generated from the LED is adopted.

FIG. 1 is a view showing a conventional radiant heat structure for a vehicle headlamp.

As illustrated in FIG. 1, the conventional radiant heat structure for the vehicle headlamp includes: an LED module 20 formed in an inner side of a housing of the head lamp; a heat sink 30 formed at a bottom surface of the LED module 20; and a cooling fan 40 installed at a lower part of the heat sink 30.

That is, the conventional radiant heat structure for the vehicle head lamp enables the heat generated from the LED module to be emitted to the outside through the heat sink 30 formed at the bottom surface of the LED module 20, and has improved radiant heat efficiency by cooling the heat sink 30 with the cooling pan 40.

However, as illustrated in FIG. 1, the conventional radiating structure for the vehicle headlamp is problematic in that a cost and a weight of the vehicle are increased and space utilization is reduced because the separate cooling fan 40 is mounted, and a cooling property is reduced because hot windy is generated in a case where the cooling fan 40 is used for long hours.

Furthermore, the lifespan of the cooling fan as well as the lifespan of the LED may become a problem, and there is also a problem that a separate electric motor is applied to the LED headlamp which pursues for low power.

Moreover, unlike a high intensity discharge (HID) or a halogen light source, the LED hardly generates infrared rays or ultraviolet rays, so it is also problematic that freezing of the headlamp is caused due to the snow and the like.

BRIEF SUMMARY

An aspect of embodiments of the present invention provides a radiating device and a lighting device that can reduce a production cost and a weight and can improve efficiency of space utilization by forming a second radiating module composed of different thermal conductive materials and removing a fan, and can also realize the effects of an optical member such as snow melting, defrosting, demisting and defogging by radiating heat to a light emitting space.

An aspect of embodiments of the present invention also provides a radiating device and a lighting device that can increase a radiant heat property by integrally forming a first radiating module and a second radiating module through insert injection molding.

According to an aspect of embodiments of the present invention, there is provided a radiating device, including: a first radiating module configured to receive heat generated from a light source module; and a second radiating module including a first member extending to the first heat dissipation module and transmitting the received heat, and a second member configured to form a light emitting space and to radiate the heat transmitted from the first member to the light emitting space.

BRIEF DESCRIPTION OF THE DRAWINGS

The accompanying drawings are included to provide a further understanding of the present invention, and are incorporated in and constitute a part of this specification. The drawings illustrate exemplary embodiments of the present invention and, together with the description, serve to explain principles of the present invention. The patent or application file contains at least one drawing executed in color. Copies of this patent or patent application publication with color drawing(s) will be provided by the Office upon request and payment of the necessary fee. In the drawings.

DETAILED DESCRIPTION

Figure 1:
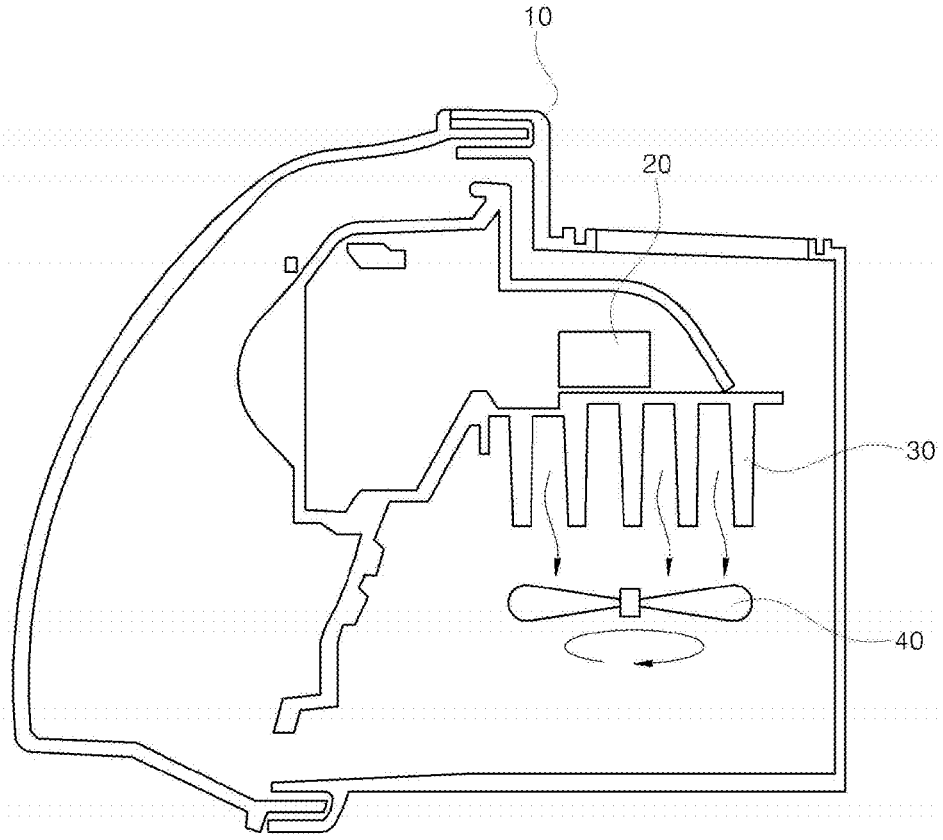
PRIOR ART FIG. 1
FIG. 1 is a view showing a conventional radiant heat structure for a vehicle headlamp.

Embodiments according to the present invention will now be described more fully hereinafter with reference to the accompanying drawings so that those having ordinary skill in the art can easily embody. This invention may, however, be embodied in different forms and should not be construed as limited to the exemplary embodiments set forth herein. It is to be understood that the form of the present invention shown and described herein is to be taken as a preferred embodiment of the present invention and that various changes and modifications may be made in the invention without departing from the spirit and scope thereof. In the following description, it is to be noted that, when the functions of conventional elements and the detailed description of elements related with the present invention may make the gist of the present invention unclear, a detailed description of those elements will be omitted. The terms below are defined in consideration of the functions of the present invention, and the meaning of each term should be interpreted by judging the whole parts of the present specification. Wherever possible, the same reference numerals will be used throughout the drawings and the description to refer to the same or like parts.

Embodiments of the present invention relate to a radiating device and a lighting device, and are intended to provide a structure of the radiating device and a structure of the lighting device that can remove a fan while improving a radiant heat effect by forming a second radiating module made of a thermal conductive resin and metal, and can realize the effects of an optical member such as the snow melting, defrosting, demisting and defogging.

Moreover, the radiating device and the lighting device according to the embodiments of the present invention can be applied to various lamp devices such as a lighting device for a vehicle, a lighting device for home use, an industrial lighting device for which illuminating is required. For example, when the radiating device and the lighting device are applied to a lamp for a vehicle, they can be also applied to a head light, a rear light and the like. In addition this, the radiating device and the lighting device can be applied to all the lighting-related applications which have been already developed and then commercialized or which can be implemented according to the technology advances.

Figure 2:
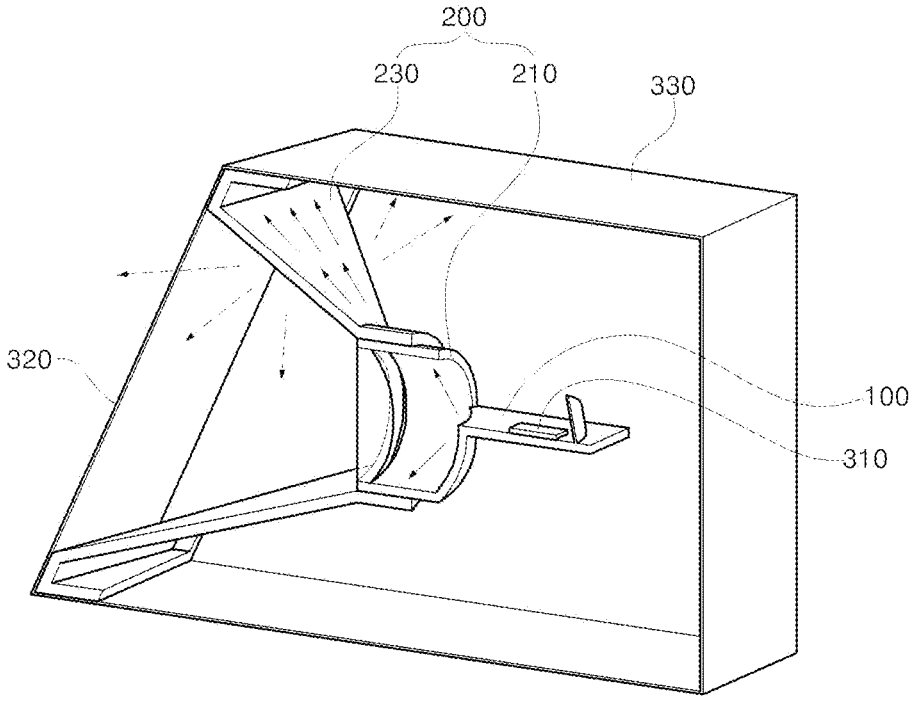
FIG. 2 through FIG. 4 illustrate various embodiments for a structure of a lighting device including a radiating device according to an embodiment of the present invention.

FIG. 2 illustrates one embodiment for a structure of a lighting device including a radiating device according to an embodiment of the present invention.

Referring to FIG. 2, the radiating device according to the present embodiment of the invention may include: a first radiating module 100 configured to receive heat generated from a light source module 310; and a second radiating module 200 configured to receive the heat received by and transmitted from the first radiating module 100 and to radiate the heat to a light emitting space. Also, the lighting device according to the present embodiment of the invention may include: an optical member 320 fixed to an end of the second radiating module 200 within a housing 330; and a light source module 310 mounted on the first radiating module 100 to emit light to the optical member.

The first radiating module 100 receives heat generated from the light source module 310 mounted in an upper part thereof. Accordingly, the first radiating module 100 may be made of a metal having high thermal conductivity, for example, Al, Cu, Ag, Cr, Ni and the like. As shown in FIG. 2, although a heat sink is not disposed at a lower part of the first radiating module 100, the present embodiment of the invention can realize an excellent radiant heat effect. Of course, it would be obvious to dispose the heat sink at the lower part of the first radiating module 100 in order to improve a radiant heat property.

The light source module 310 mounted in the upper part of the first radiating module includes a printed circuit board and a light emitting device mounted to the printed circuit board to emit light. The light emitting device may be a light emitting diode (LED).

The second radiating module 200 may include: a first member 210 extending to the first radiating module 100 and transmitting the heat received in the first radiating module 100; and a second member 230 configured to form a light emitting space and to radiate the heat transmitted from the first member 210 to the light emitting space. The first member 210 and the second member 230 may be manufactured in a separable structure. Although the drawing shows that the first member 210 is disposed at a lower part of the second member 230, the second member may be disposed at a lower part of the first member.

At this time, the first and second members 210, 230 may be made of materials having different thermal conductivities. More specifically, like the first radiating module 100, the first member 210 may be made of a metal such as Al, Cu, Ag, Cr, Ni and the like having a high thermal conductivity. The second member 230 may be made of a thermal conductive material having a higher radiative emission rate than that of the first member 210, and more specifically, it may be made of a thermoplastic resin or a thermal conductive filler composed of any one of polyphenylene sulfide (PPS), a liquid crystal polymer (LCP), polycarbonate (PC) and nylon. At this time, the thermal conductive filler may be composed of a combination of metal series such as a metal oxide, a metal carbide, a metal powder and the like, graphite, carbon series such as a carbon fiber and the like, or ceramic metal carbon series.

The optical member 320 is fixed to an end part of the second member to emit light to the outside. The optical member 320 may include all optical substrates such as a lens, a transparent substrate, a translucent substrate and the like which emit light emitted from a light source to the outside. Accordingly, a lighting device for a vehicle may be an optical member for a vehicle, for example, an outer lens in a head lamp or a rear lamp.

Also, in the radiating device and the lighting device according to the present embodiments of the invention, a surface treatment layer (not drawn) may be formed on a surface of the first member 210 in order to improve a radiative emission rate. At this time, the surface treatment layer may be formed by anodizing processing, carbon nanotube (CNT) or silicone coating, and powder coating, and may be formed such that the more the surface treatment layer is spaced apart from the first radiating module 100, the more radiative emission rate increases.

In accordance with the present embodiment of the invention, the heat generated from the light source module 310 is received and transmitted by the first radiating module 100 and the first member 210 which are made of the thermal conductive metal, and is emitted through the second member 230 including the thermoplastic resin. In particular, although direct heat transfer through the second member 230 is low compared to that of the first member 210 made of the material having the high thermal conductivity, since the second member 230 is made of the thermal conductive material having the high radiative emission rate, a greater amount of heat than that of the first member 210 is radiated to the light emitting space. Thus, thanks to the heat radiated to the light emitting space, a surface temperature of the optical member 320 increases, thereby melting of snow, ice formation and the like being present on the surface of the optical member 320, defrosting, demisting, defogging and the like. Furthermore, unlike the conventional radiating device and lighting device, although the present embodiments of the invention have no fan, the radiant heat effect can be improved. Furthermore, as the fan is removed, a production cost and a weight can be reduced, and space utilization can be also improved.

Figure 3:
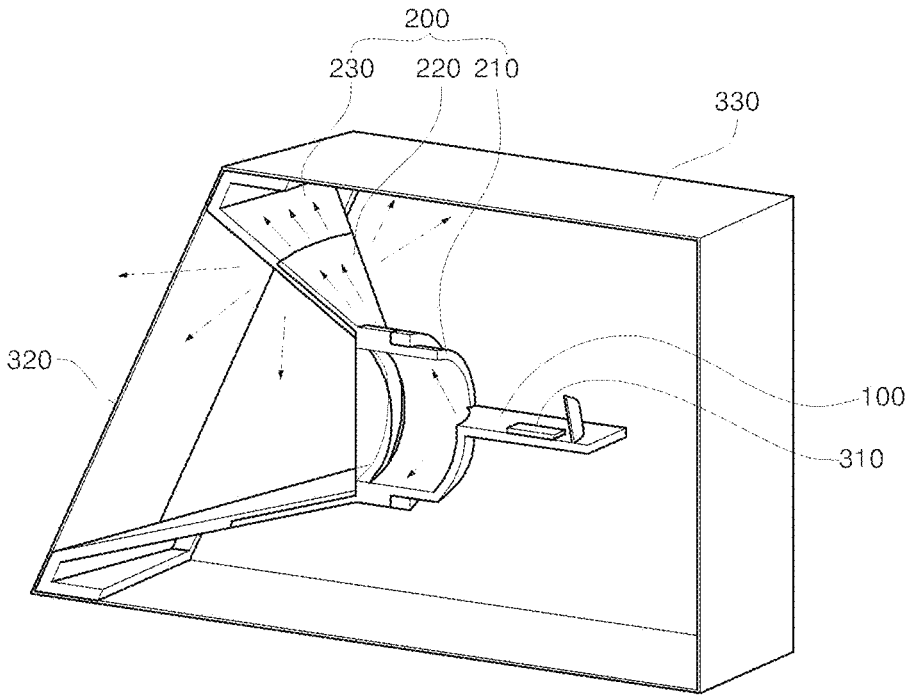
Figure 4:
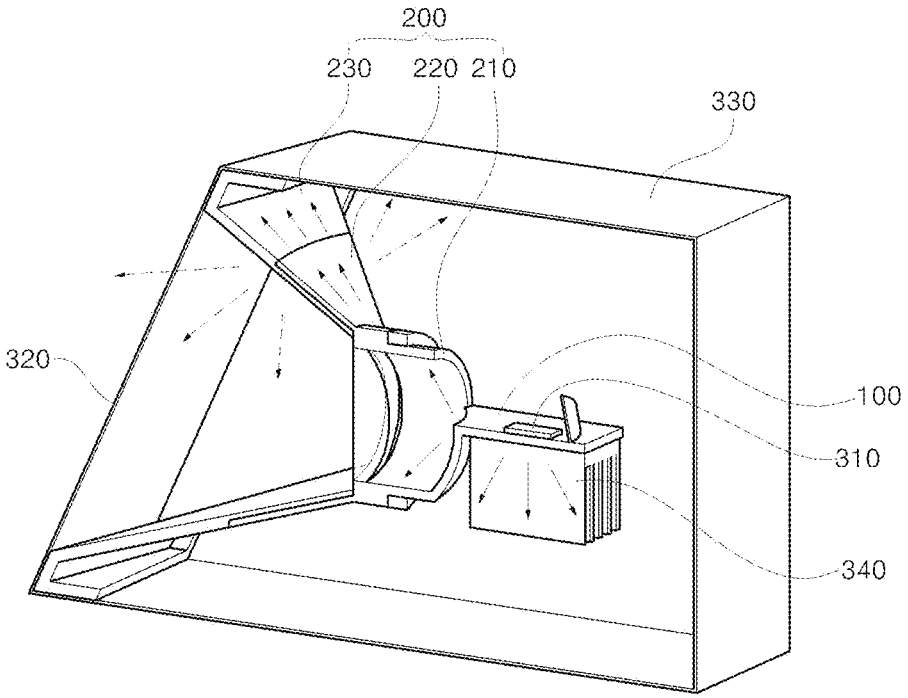

FIG. 3 and FIG. 4 illustrate other embodiments for the structure of a lighting device including a radiating device according to other embodiments of the present invention. The description on repeated elements with those of FIG. 2 will be hereinafter omitted, and the structure will be described based on a difference.

FIG. 3 is a side sectional view showing a structure in which the first radiating module 100 and the second radiating module 200 are integrally formed by insert injection molding, and FIG. 4 is a side sectional view showing a structure in which a heat sink 340 is added to the lighting device of FIG. 3.

In FIG. 2, the thermoplastic resin applied to the second member has anisotropy 230 has anisotropy due to the thermal conductive filler. It is not easy for the general thermal conductive resin to transmit heat in a vertical direction because thermal conductivity in a through-plane direction is relatively low compared to that in an in-plane direction, and contact resistance between the first member 210 and the second member 230 is high, so radiant heat efficiency can be reduced. Thus, in the other embodiment of the present invention, as shown in FIG. 3, as the first radiating module 100 and the second radiating module 200 are integrally formed by insert injection molding, heat transfer may be easily conducted, and as contact resistance between the first member 210 and the second member 230 is reduced, an assembly property as well as a radiant heat effect can be improved.

In particular, a laminated portion 220 in which the first member 210 and the second member are laminated may be formed in the second radiating module 200. The laminated portion 220 may have a structure in which the second member 230 is laminated on an upper surface of the first member 210. In addition to this, in order to increase a radiation rate and prevent glariness from being generated at the outside, the laminated portion may have a structure, as illustrated in FIG. 3, in which the first member is laminated on an upper surface of the second member 230. As a result, the first member 210 made of the metal having the high thermal conductivity may lead the transmission of heat, and the second member 230 may radiate the heat to the light emitting space.

Although FIG. 3 illustrates that the first radiating module 100 and the second radiating module 200 are integrally formed by the insert injection molding, the structure is not limited thereto. As another embodiment, only the first member 210 and the second member 230 may be integrally formed by insert injection molding or only the second member 230 and the laminated portion 220 may be integrally formed by insert injection molding.

Table 1 below shows the comparison of thermal resistance for thermal diffusion members of the lighting device shown in FIG. 3 according to the present embodiment of the invention and the conventional lighting device for a vehicle.

TABLE 1

| Division | Main Heat Source | Thermal Diffusion Member | Thermal Resistance ($R_{sa}$) |
|---|---|---|---|
| Conventional lighting device 1 (A) | 1. LED<br>2. Electric Motor | Heat Pipe<br>Heat Sink | 3 K/W |
| Conventional lighting device 2 (B) | 1. LED | Fan<br>Heat Sink | 2.5 K/W |
| Conventional lighting device 3 (C) | 1. LED<br>2. Electric Motor<br>3. Engine | Heat Sink | 2.9 K/W |
| Lighting device according to the present embodiment of the invention (D) | 1. LED<br>2. Engine | First and Second Radiating Module | 2.27 K/W |

In Table 1 above, (A) has the LED, the electric motor, the engine as a main heat source and diffuses heat through the heat sink of the heat pipe, (B) has the LED as a main heat source and diffuses heat through the fan and the heat sink, (C) has the LED, the electric motor and the engine as a main heat source and diffuses heat through the heat sink, and (D) according to the present embodiment of the invention has the LED and the engine as a main heat source and diffuses heat through the first radiating module and the second radiating module.

As shown in Table 1 above, although the lighting device according to the present embodiment of the invention has no fan or heat sink, it shows lowest thermal resistance. Thus, it can be confirmed that the lighting device has the best radiant heat performance. Thanks to the radiant heat performance of the present embodiment of the invention, the effects such as snow melting, defrosting, demisting, and defogging can be realized.

Moreover, (A) has a problem such as a high weight because the heat pipe and the heat sink are used as a heat diffusion member, (B) has a problem such as the credibility and noise of a fan, and a high cost because the fan and the heat sink are used as a heat diffusion member, (C) has a problem such as a high weight because only the heat sink as a large-sized radiating plate is used as a heat diffusion member. However, in the present embodiment of the invention, although the fan and the heat sink are not provided, in addition to the excellent radiant performance, the weight can be maximally reduced up to 80%, and the problem such as the noise and credibility can be also settled.

As explained in FIG. 2, the radiating device and the lighting device according to the present embodiments of the invention can realize the excellent radiant effect even without the heat sink. However, in order to improve the radiant heat property, as shown in FIG. 4, the heat sink 340 may be disposed at a lower part of the first radiating module 100. Also, the surface treatment layer explained in FIG. 2 may be also applied to the lighting device of FIG. 3 and FIG. 4.

Figure 5:
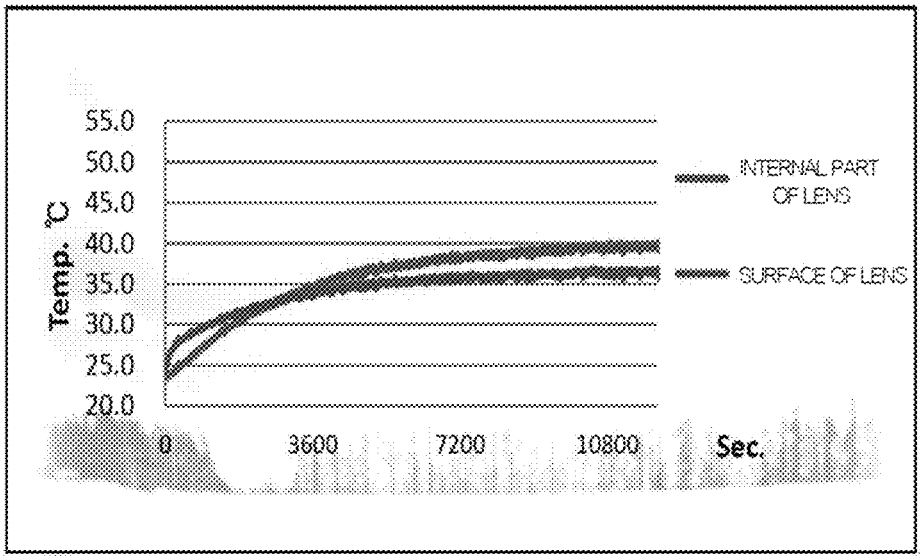
FIG. 5 illustrates experimental results for radiant heat performance of a conventional lighting device for a vehicle and a lighting device for a vehicle according to another embodiment of the present invention.
Figure 5:
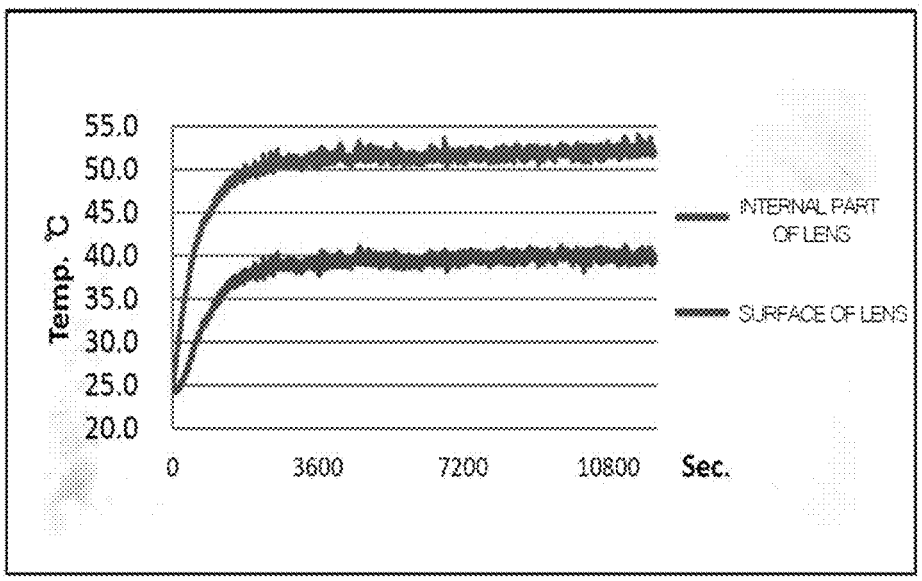

FIG. 5 and Table 2 below show experimental results for radiant heat performance based on the comparison of internal part and surface temperatures of each lens of the conventional lighting device for the vehicle having the fan and the lighting device for the vehicle according to still another embodiment of the present invention.

TABLE 2

| Division | ΔT = 10° C. Reaching Time (min) | Maximum Temperature of Lens Surface (° C.) |
|---|---|---|
| Conventional Lighting Device (having a fan) | 64 | 36.6 |
| Lighting device according to the present embodiment of the invention | 18 | 39.8 |

In FIG. 5 and Table 2, the lighting device for the vehicle according to the present embodiment of the invention in which the fan is removed can increase the internal part and surface temperature in a shorter time compared to the conventional lighting device for the vehicle having the fan, and it can also increase a maximum temperatures of the internal part and surface of the lens to be higher. Thus, the lighting device for the vehicle according to the present embodiment of the invention has a high radiant heat property and radiation rate compared to the conventional lighting device for the vehicle. Furthermore, in spite of the removal of the fan, the excellent radiant heat effect can be realized, and the effects such as snow melting causing the melting of snow collected on the optical substrate, defrosting, demisting, and defogging can be also realized.

Figure 6:
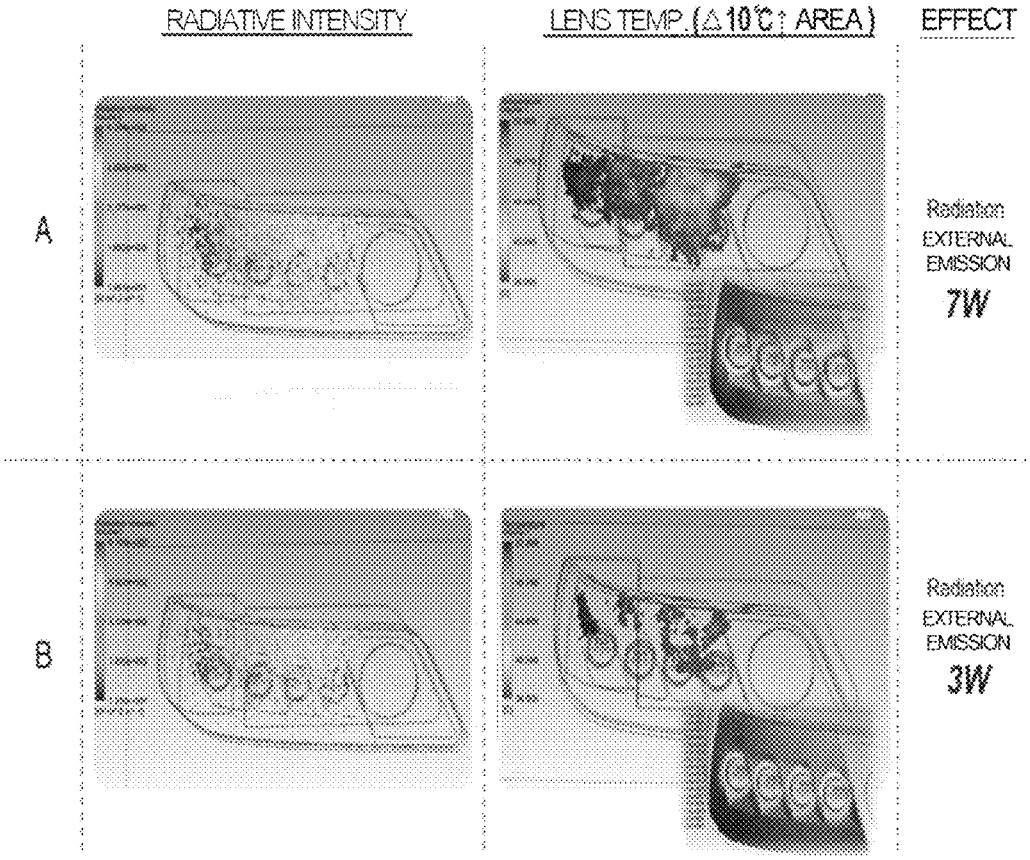
FIG. 6 illustrates transmission simulation results for each outer lens of a lighting device for a vehicle to which a bezel made of a general plastic material is applied and a lighting device for a vehicle according to still another embodiment of the present invention to which a thermal conductive resin is applied.

FIG. 6 illustrates transmission simulation results for outer lenses of a lighting device for a vehicle A according to still another embodiment of the present invention in which a thermoplastic resin is applied to the second member, and a lighting device for a vehicle B to which a bezel made of a general plastic material is applied.

In FIG. 6, the outer lenses under the same conditions (refractive index: 1.56, absorption coefficient: 3.8[cm-1], and scattering coefficient: 12.8[cm-1]) are mounted to both A and B. In A, as the second member, a thermoplastic resin having a thermal conductivity of 5 W/mK is applied, and in B, a polycarbonate having a thermal conductivity of 0.2 W/mK is applied. As a result, it is shown that A can additionally radiate the heat of 4 W compared to B. Thus, in the present embodiment of the invention, radiant heat efficiency is improved by the second member, so a heat flux of an external part of the lens increases. Thus, the effects such as snow melting, defrosting, demisting and defogging can be realized.

Figure 7:
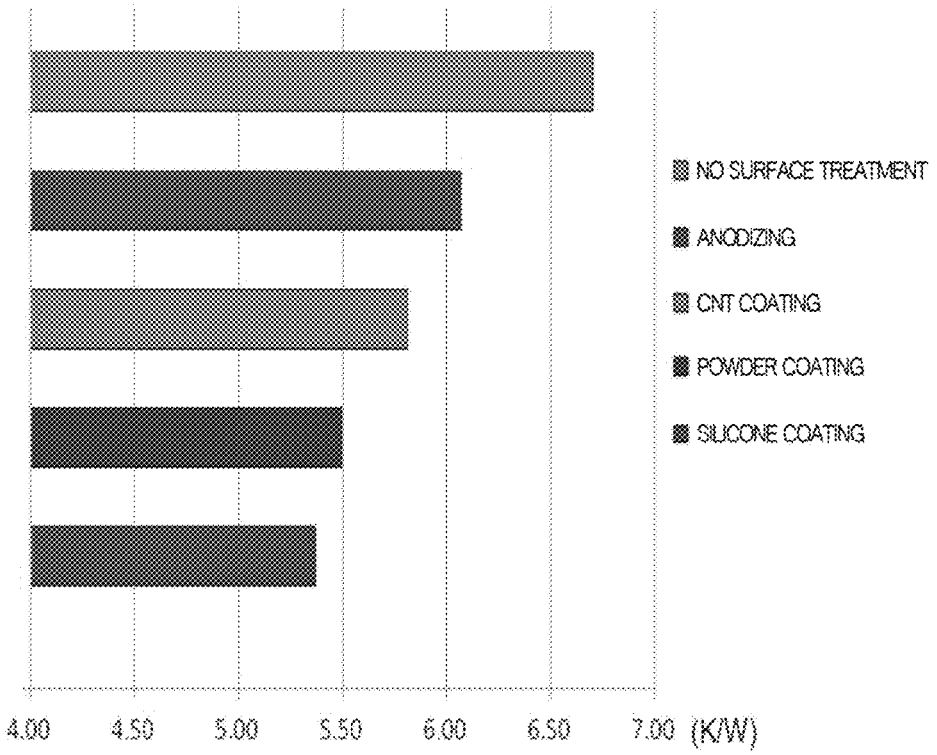
FIG. 7 illustrates experimental results for thermal resistance of a radiating device having no surface treatment layer, and a radiating device having a surface treatment layer according to still further another embodiment of the present invention.

FIG. 7 illustrates experimental results for thermal resistance of a radiating device having no surface treatment layer, and a radiating device having a surface treatment layer according to still further another exemplary embodiment of the present invention.

In FIG. 7, it is shown that the radiating device according to the present embodiment of the invention in which the surface treatment layer is formed by anodizing processing, carbon nanotube (CNT) or silicone coating, power coating or the like can increase a radiation rate up to 20% or more to the fullest compared to the radiating device in which the surface treatment layer is not formed. Accordingly, although a radiative emission rate of the second member is low, a radiation rate can be improved thanks to the surface treatment layer formed on the surface of the first member.

As set forth above, according to embodiments of the invention, as the second radiating module including different thermal conductive materials from each other is provided, the fan can be removed, and due to the removal of the fan, a cost and a weight can be reduced, and space utilization can be improved. Furthermore, thanks to the radiation of heat through the second member, the effects of an optical member such as snow melting, defrosting, demisting and defogging can be realized.

Furthermore, since the first radiating module and the second radiating module are integrally formed by insert injection molding, although the fan and the heat sink are removed, a radiant heat property can be improved.

Moreover, since the surface treatment layer is formed on the surface of the first member, although the radiative emission rate of the second member is low, the heat radiation effect can be improved thanks to the first member.

As previously described, in the detailed description of the invention, having described the detailed exemplary embodiments of the invention, it should be apparent that modifications and variations can be made by persons skilled without deviating from the spirit or scope of the invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims and their equivalents.

What is claimed is:

1. A lighting device comprising:

a housing;

an optical member emitting light to outside;

a radiating device within the housing; and a light source module; wherein the radiating device has a first radiating module configured to receive heat generated from the light source module; and a second radiating module that comprises a first member extending to the first radiating module and transmitting the received heat, a second member configured to emit the heat transmitted from the first member to a light emitting space, and a laminated portion in which the first member and the second member are laminated, wherein the laminated portion is configured such that the-first second member is laminated on an inner surface of the member;

wherein the first radiating module and the first member each comprises thermal conductive metal, wherein the second member comprises thermal conductive material having a radiative emission rate higher than that of the first member and having an anisotropy of thermal conductivity, wherein the second member has two end parts contacting an inner surface of the optical member, wherein the inner surface faces the radiating device, and the end parts contact an inner surface of the housing, wherein the light source module is mounted on the first radiating module to emit light, and wherein a surface area of the second member gradually increases from an end adjacent to the first member to an end adjacent to the optical member.

2. The lighting device of claim 1, wherein the first member and the second member are made of materials having different thermal conductivities.

3. The lighting device of claim 1, wherein the light source module is mounted on an upper part of the first radiating module.

4. The lighting device of claim 1, wherein the thermal conductive material comprises a thermoplastic resin.

5. The lighting device of claim 4, wherein the thermoplastic resin is any one of polyphenylene sulfide (PPS), a liquid crystal polymer (LCP), polycarbonate (PC) and nylon.

6. The lighting device of claim 1, further comprising a surface treatment layer for an increase in radiative emission rate on a surface of the first member.

7. The lighting device of claim 6, wherein the surface treatment layer is configured such that a radiative emission rate increases as the surface treatment layer is further spaced apart from the first radiating module.

8. The lighting device of claim 6, wherein the surface treatment layer is an anodizing processing layer or a carbon nanotube (CNT) or silicone coating layer.

9. The lighting device of claim 1, wherein the first radiating module, the first member, and the laminated portion are integrally formed, and wherein the second member and the laminated portion are integrally formed.

10. The lighting device of claim 1, further comprising a heat sink disposed under the first radiating module.

11. The lighting device of claim 1, wherein the light source module is a light emitting diode (LED) mounted to a printed circuit board.

* * * * *